US008540351B1

(12) United States Patent
Love, III et al.

(10) Patent No.: US 8,540,351 B1
(45) Date of Patent: Sep. 24, 2013

(54) DEFLECTION PLATE FOR LIQUID JET PRINTER

(75) Inventors: Franklin S. Love, III, Columbus, NC (US); Jeffrey J. Lillie, Simpsonville, SC (US); Daniel T. McBride, Chesnee, SC (US); Rajib Mondal, Greer, SC (US); Robert M. MacMeccan, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 102 days.

(21) Appl. No.: 13/411,684

(22) Filed: Mar. 5, 2012

(51) Int. Cl.
*B41J 2/085* (2006.01)

(52) U.S. Cl.
USPC ..... 347/76

(58) Field of Classification Search
USPC ..... 347/73–82, 90
See application file for complete search history.

(56) References Cited

U.S. PATENT DOCUMENTS

| | | | | |
|---|---|---|---|---|
| 4,928,113 | A * | 5/1990 | Howell et al. | 347/76 |
| 5,969,733 | A | 10/1999 | Sheinman | |
| 6,003,980 | A | 12/1999 | Sheinman et al. | |
| 6,106,107 | A | 8/2000 | Sheinman | |
| 6,511,164 | B1 * | 1/2003 | Bajeux | 347/74 |
| 6,848,774 | B2 * | 2/2005 | Shrivastava et al. | 347/77 |
| 7,104,634 | B2 | 9/2006 | Weksler et al. | |
| 7,182,442 | B2 | 2/2007 | Sheinman | |
| 7,438,396 | B2 | 10/2008 | Weksler et al. | |
| 7,524,042 | B2 | 4/2009 | Weksler et al. | |
| 7,594,717 | B2 | 9/2009 | Sheinman | |
| 8,414,111 | B2 * | 4/2013 | Nakakubo | 347/77 |
| 2007/0257971 | A1 * | 11/2007 | Jeanmaire | 347/82 |
| 2008/0106564 | A1 | 5/2008 | Lifshitz et al. | |

* cited by examiner

*Primary Examiner* — Kristal Feggins

(74) *Attorney, Agent, or Firm* — Brenda D. Wentz

(57) ABSTRACT

A liquid jet printing apparatus is provided having a nozzle for emitting a stream of liquid droplets toward a substrate, a charging section for providing an electrical charge to liquid droplets and a pair of electrically conductive deflecting plates for deflecting the liquid droplets to a desired location on the substrate, wherein the inside face of the deflecting plates is provided with dielectric layer to minimize problems associated with liquid droplets collecting and coalescing on the deflecting plates.

22 Claims, 2 Drawing Sheets

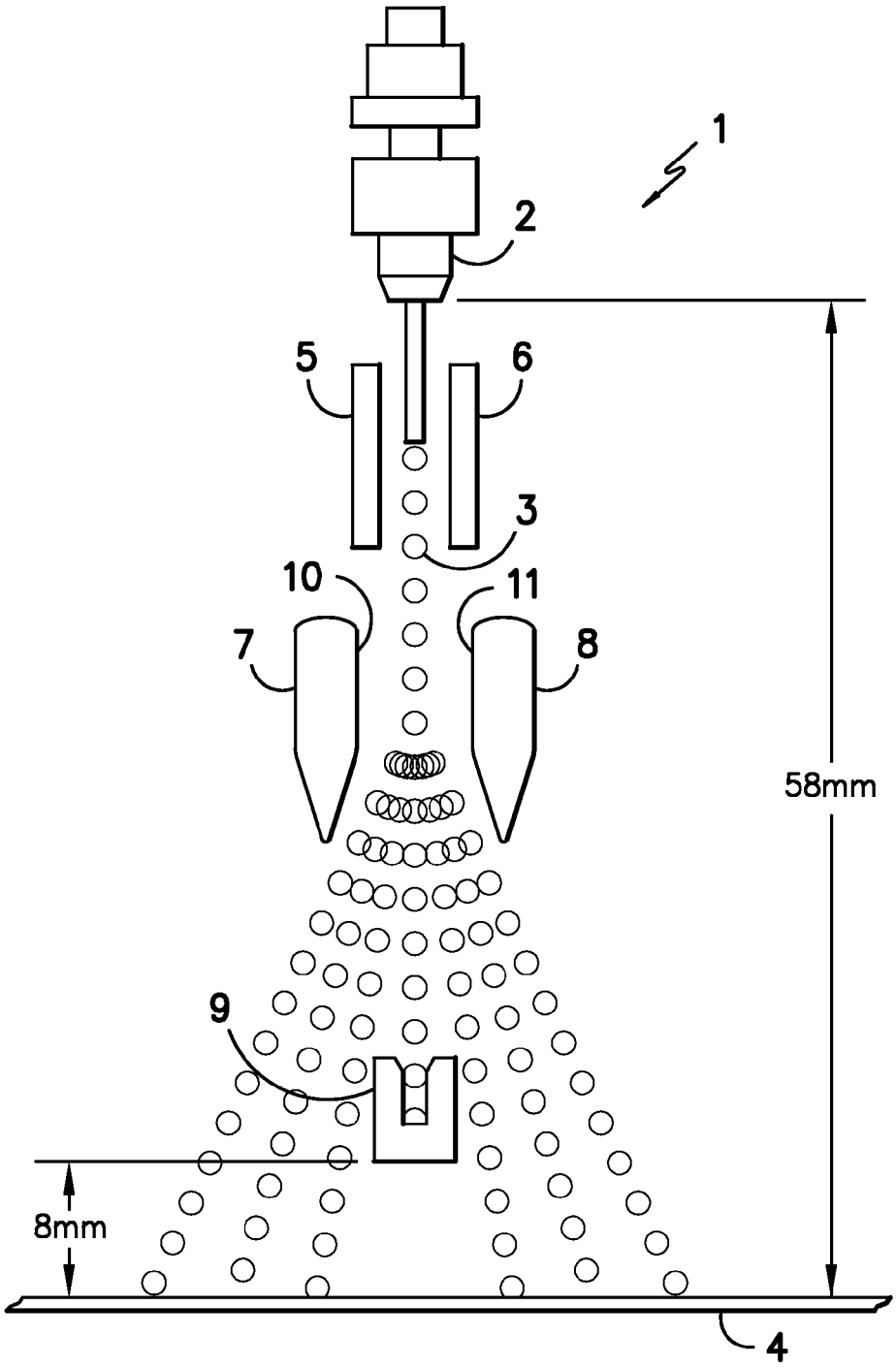
FIG. —1—

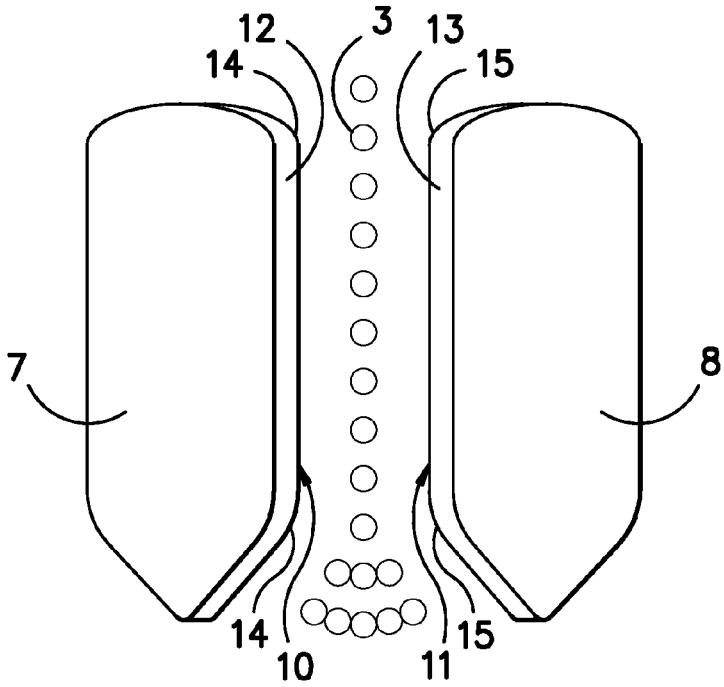
FIG. —2—
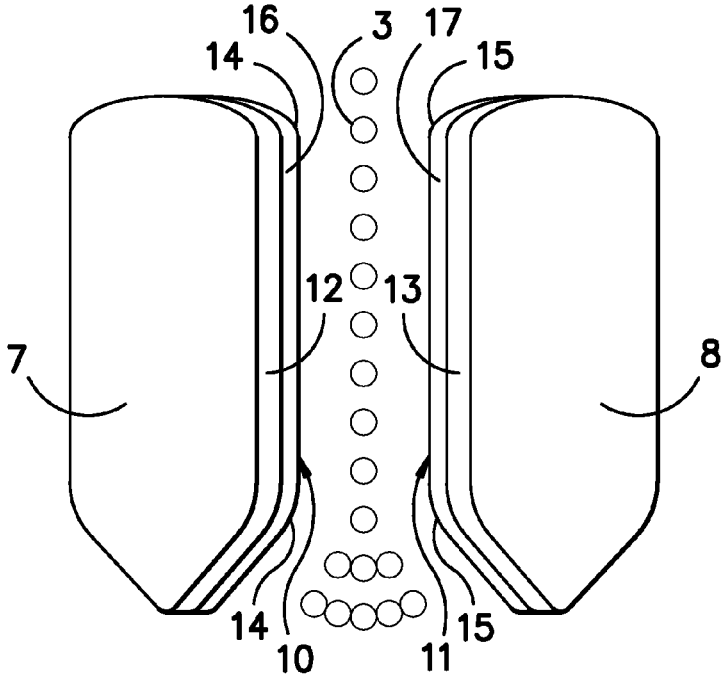
FIG. —3—

DEFLECTION PLATE FOR LIQUID JET PRINTER

This invention relates generally to a liquid jet printer having electrically charged deflection plates to direct the path of a droplet of liquid, and in particular to deflection plates having a high dielectric strength coating on the surface to reduce arcing.

BACKGROUND OF THE INVENTION

The present invention is directed to a liquid jet printer having (i) a droplet formation section, such as a piezoelectric transducer, (ii) a droplet charging section, such as parallel metal plates, and (iii) a droplet deflection section, for directing the path of the droplet to the desired location on a substrate to be printed. In the case of continuous jet printing, a stream of individual droplets is produced, with some of the droplets impinging on the substrate in the desired pattern. The remaining droplets are intercepted by a collection device, such as a gutter, and are recycled to the droplet formation section, rather than printed on the substrate.

U.S. Pat. No. 7,438,396 B2 discloses a continuous ink jet printer having an array of nozzles for simultaneously printing across the width of a substrate, such as a textile fabric. The range of deflection of the droplets is such that adjacent nozzles can overlap, to print a seamless pattern on the substrate. The deflection plates are spaced apart and oppositely charged, for example at 1 to 5 kV, to produce an electrical field. The charge on the droplets and/or the strength of the electrical field created by the deflection plates can be varied, to create more or less deflection of the droplet. In one example, uncharged droplets are not deflected and collect in the gutter.

During operation of the printer, liquid droplets can accumulate on the surface of the deflection plates. The accumulation may be caused by splatters from the gutter, misdirected drops, or from rebound of ink off the surface of the substrate that is being printed. The accumulation can coalesce on the surface of the deflection plate reducing the effective gap to below the breakdown potential of air and cause arcing from one plate to the adjacent oppositely charged plate.

SUMMARY OF THE INVENTION

The invention is directed to a liquid jet printing apparatus having a nozzle capable of emitting a stream of individual droplets of liquid toward a substrate, a droplet charging section capable of providing an electrical charge to the droplets, and a pair of electrically conductive deflecting plates for creating an electrical field capable of deflecting the droplets to a desired location of the substrate. The liquid jet printer may emit a continuous stream of liquid droplets or emit liquid droplets on demand. In the case of a continuous liquid jet printer, a collection device, such as gutter, is interposed between the nozzle and the substrate, to prevent at least some of the droplets from impinging upon the substrate, for example, when a particular color of liquid is not part of the pattern being printed.

Each of the deflecting plates has an interior side facing the path of the stream of individual droplets of liquid. An outer layer of the interior side of one or both of the deflecting plates is a dielectric. The dielectric outer layer is selected from a variety of materials that are capable of insulating liquid droplets collected on the deflecting plates, providing a voltage drop between the deflecting plate and collected liquid droplets and/or decreasing arcing between the pair of deflecting plates.

The dielectric outer layer of the deflecting plates may be a coating applied to the surface of the plate. By way of example, the dielectric coating may be a poly(p-xylylene) polymer, a silicone oxide polymer or an oxide of perovskite. In another embodiment of the invention, the dielectric outer layer may be a metal oxide, such as an oxide of a valve metal. The metal oxide layer may be created by etching the interior surface of the deflecting plate, followed by growing the corresponding oxide on the etched surface. By way of example, the deflecting plate may be aluminum and the dielectric outer layer may be $Al_2O_3$.

The dielectric preferably has a relatively high dielectric strength, thereby minimizing the thickness of the dielectric layer required to avoid breakdown of the electrical field. Additionally, the thinner the dielectric layer, the less likely that the deflecting plate will encroach upon the path of the liquid jet droplets, thereby decreasing the number of liquid droplets impinging upon the surface of the deflecting plate. By way of example, dielectrics having a dielectric strength of 4000 V/mil or greater, are believed to be particularly useful in the present invention. Dielectric layers ranging from 100 nm to 0.1 mm in thickness may be used.

The invention may further include a hydrophobic film overlaying the dielectric outer layer. Or, the dielectric layer may itself be hydrophobic. The hydrophobic film minimizes the size of the liquid droplets that coalesce on the deflecting plates. Smaller drops of liquid are less likely to cause arcing between the deflecting plates or other breakdown of the electrical field. Additionally, the hydrophobic film results in smaller drops of liquid releasing from the deflecting plates from gravity, and smaller drops of liquid are less noticeable, if they should drip from the deflecting plates on to the substrate.

The present invention is useful with aqueous based compositions. Accordingly, the efficacy of the hydrophobic film or hydrophobic dielectric layer may be characterized by a contact angle between water and the hydrophobic surface of 85° or greater. Contact angles are measured by a Krüss droplet shape analyzer. Examples of suitable hydrophobic materials are functionalized and unfunctionalized polyolefins, polytetrafluoroethylenes, glass, quartz, epoxies, and poly(p-xylene).

The present invention also includes a method of printing characterized by using the jet printing apparatus to print on a substrate.

BRIEF DESCRIPTION OF THE DRAWINGS

FIG. 1 is a side view depicting an arrangement of a nozzle, charging station, deflection station used to print on a substrate.

FIG. 2 is a side view of the deflecting plates of the present invention, with a dielectric layer.

FIG. 3 is a side view of the deflecting plates of the present invention, with a dielectric layer and hydrophobic film.

DETAILED DESCRIPTION OF THE INVENTION

Without limiting the scope of the invention, the preferred embodiments and features are hereinafter set forth. All of the United States patents, which are cited in the specification, are hereby incorporated by reference. Unless otherwise indicated, conditions are 25° C., 1 atmosphere of pressure and 50% relative humidity, concentrations are by weight, and molecular weight is based on weight average molecular weight.

The term "polymer" or "polymeric material" as used in the present application denotes a material having a weight average molecular weight (Mw) of at least 5,000. Such polymeric materials can be amorphous, crystalline, or semi-crystalline materials, including elastomeric polymeric materials. Unless otherwise indicated, the term "alkyl" refers to $C_1$ to $C_6$ aliphatic groups.

Liquid Jet Printer

Referring to FIG. 1, the present invention is useful in combination with a liquid jet printer 1, having a nozzle 2 capable of emitting a stream of individual droplets of liquid 3 toward a substrate 4. The droplets may be created by a piezoelectric transducer, incorporated into nozzle 2. The droplets follow a path through charging plates 5 and 6, capable of providing an electrical charge to the liquid droplets, and a pair of electrically conductive deflecting plates 7 and 8, for creating an electrical field capable of deflecting liquid droplets 3 to a desired location of substrate 4. The amount of deflection undergone by the droplets 3 can be controlled by varying the electrical charge placed on the droplet by charging plates 5 and 6, varying the electrical field created by deflecting plates 7 and 8, or both varying the charge and the electrical field imposed upon an individual droplet.

Liquid jet printer 1 may emit a continuous stream of liquid droplets or emit liquid droplets on demand. In the case of a continuous liquid jet printer, a collection device, such as gutter 9, is interposed between nozzle 2 and the substrate 4, to prevent liquid droplets 3 from impinging upon substrate 4, for example, when a particular color of liquid is not part of the pattern being printed. In the example shown, gutter 9 is positioned to collect undeflected liquid droplets 3. It may be understood that the gutter can be positioned to collect deflected liquid droplets, and the droplets that are not intended to impinge upon the substrate can be deflected to the gutter.

Examples of liquid jet printers compatible with the present invention may be found in U.S. Pat. No. 7,438,396; U.S. Pat. No. 7,594,717; U.S. Pat. No. 7,524,042; U.S. Pat. No. 7,182,442; U.S. Pat. No. 7,104,634; U.S. Pat. No. 6,106,107; U.S. Pat. No. 6,003,980; U.S. Pat. No. 5,969,733; and US Patent Application No. 2008/0106564.

The present invention may employ a variety of liquid compositions. By way of example, the composition may be aqueous or non-aqueous. A colorant present in the composition may be a dye or pigment. The composition may also include binders, dispersants, co-solvents, surface energy modifiers, such as glycol, and salts. The present invention is useful with liquid compositions incorporating a colorant, for example, an acid dye, a disperse dye and/or a reactive dye. In one embodiment of the invention, the liquid is an aqueous composition having a dye dissolved therein.

Dielectric Layer

Each of the deflecting plates 7 and 8 has an interior side 10 and 11, respectively, facing the path of the stream of liquid droplets 3. Referring to FIG. 2, deflecting plates 7 and 8 have a dielectric layer 12 and 13, respectively, on the interior sides 10 and 11. The dielectric layer insulates the jet of liquid droplets from a deflecting plate, when the droplets happen to collect and coalesce on the interior sides of a deflecting plate. Accordingly, the drops are less likely to cause arcing, sparking or other breakdown of the electrical field between the deflecting plates, while at the same time the electrical field that steers the droplets is essentially unchanged from using uncoated plates. The result is that print quality is not affected, but the ability for an arc to occur has been eliminated.

The dielectric layer may be a coating applied to the outer surface of the interior sides of the deflecting plates, or depending on the composition of the outer surface of the deflecting plate, the dielectric layer may be formed by creating a metal oxide layer on the deflecting plate, such as by etching a valve metal and forming an oxide layer on the surface. By way of example, dielectrics having a dielectric strength greater than 500 V/mil or a dielectric strength greater than 2000 V/mil or even a dielectric strength greater than 4000 V/mil are believed to be useful in the present invention. The thickness of the dielectric layer necessary to achieve the desired insulating effect will vary depending upon the dielectric strength of the material employed, with the thickness being inversely proportional to dielectric strength. In general, dielectric layers ranging in thickness from 100 nm to 0.1 mm may be employed.

Materials useful for dielectric coatings include poly(p-xylylene) polymers, silicon polymers, such as silicon dioxide and silicone oxide polymers, or oxides of perovskite. Additionally, the dielectric coating may be selected from polyurethanes, epoxy polymers, polyolefins, and polyacrylates. In particular, the dielectric coating may be Parylene-N, -C, -D, or -HT, polydimethylsiloxane and pendant ("rake") functionalized polydimethylsiloxanes, $BaTiO_3$, $(Ba,Sr)TiO_3$ or BST, $PbZr_XTi_{1-X})O_3$ or PZT, $SrBi_2Ta_2O_9$ or SBT, $SiO_2$ optionally doped with phosphorous and silicon nitride. Materials that are insoluble in the liquid composition that emits from nozzle are preferred. The coating is applied to achieve a uniform thickness, free from defects, such as pinholes. By way of example, a parylene polymer may be applied to the outer surface of a deflecting plate by vapor deposition. The coating may also be a metal oxide, such as an oxide of a "valve metal" applied to the surface of the deflecting plate, for example by sputtering or chemical vapor deposition of the metal, followed by oxidation, to provide a dielectric layer.

In an alternative embodiment of the invention, the dielectric layer may be formed by treatment of a deflecting plate comprised of a metal capable of undergoing oxidation to form a dielectric layer. Such metals are typically referred to as "valve metals" and include aluminum, titanium, tantalum, zirconium, hafnium, vanadium, niobium, silicon and tungsten. Various processes for treating a metal surface to create a dielectric layer are known to those skilled in the art and include the process of etching the surface of the metal followed by growing the oxide on the surface or thermal oxidation.

Referring to FIGS. 2 and 3, the edges 14 and 15 of deflecting plates 7 and 8, respectively, are rounded to prevent arcing by reducing field intensity and to facilitate creating a more uniform coating of the dielectric material.

Hydrophobic Layer

Liquid droplets that collect on the deflecting plates increase the risk of arcing between the plates or other breakdown of the electrical field. The risk increases if the droplets coalesce on the deflecting plates to form larger drops. Additionally, the larger the drop of liquid that forms on the deflecting plate, the more likely the drop is to create a defect in the print pattern, should the drop fall on the substrate below.

It has been found that the detrimental effects of liquid drop accumulation are ameliorated by providing the inside surface of the deflecting plates with a hydrophobic surface. Aqueous based dye solutions are of particular interest. Consequently, the inside surface of the deflecting plates may advantageously be hydrophobic. In one embodiment of the invention, the surface of the deflecting plate is hydrophobic and is characterized by a contact angle between water and the hydrophobic surface of 85° or greater, as measured by Krüss droplet shape analyzer.

The hydrophobic surface may result from the dielectric layer that has been provided on the outer layer of the deflecting plate. Alternatively, the hydrophobic surface may be provided by a hydrophobic film that has been applied over the dielectric layer. Examples of suitable hydrophobic materials are functionalized and unfunctionalized polyolefins, such as polyethylene, polypropylene, ethylene/propylene copolymers, fluoropolymers, such as polytetrafluoroethylene and fluoroalkyl acrylate copolymer, glass, quartz, epoxies, polyacrylates, and polyurethanes.

Referring to FIG. 3, hydrophobic films 16 and 17 coat dielectric layers 12 and 13 of deflecting plates 7 and 8, respectively.

In one embodiment of the invention, the hydrophobic surface incorporates particulates, such as fumed silica, to achieve a desired microstructure, and use of a cross-linkable polymer and cross-linking agent to improve durability and abrasion resistance. By way of example, cross-linkable tetrafluoroethylene copolymer and toluene diisocyanate may be included in the film formulation to improve durability.

Example 1

An aluminum deflecting plate was coated with Parylene C using vapor deposition, to create a dielectric layer. The dielectric layer was approximately 1.5 mils (40 μm) thick and had a dielectric strength of 5600 V/mil (measured using ASTM D 149 test method). The coated deflecting plates were used in a liquid jet printing apparatus, as shown in FIG. 1, with a spacing of 0.157 inches (4 mm) between the inside surfaces of the deflecting plates. The introduction of the dielectric coating greatly reduced arcing and droplet coalescence on the surface of the deflecting plate, without any negative impact on print quality observed.

Example 2

A hydrophobic coating was prepared by homogenizing fumed silica particles (Aerosil R812S) in decane and blending 5 weight % of the silica with a fluoroalkyl acrylate copolymer (Unidyne TG658). The deflecting plates obtained from Example 1 were dip coated in the hydrophobic coating composition and cured at 250° F. for 5 minutes. The hydrophobic coating was found to reduce coalescence of liquid droplets and reduce the amount of liquid accumulated on the deflecting plates, when employed in a liquid jet printing apparatus, as shown in FIG. 1.

Applications

The present invention is useful in both continuous and on-demand liquid jet printers employing charged deflecting plates to direct the application of liquid droplet to a substrate. Useful substrates include paper, polymer film and textiles, including woven and knitted fabrics, carpet, rugs and carpet tile, and including textiles made of natural and synthetic fibers or combinations thereof. Of particular interest is the use of aqueous liquid compositions containing acid dyes, in combination with substrates containing nylon fibers.

The printing head incorporating the nozzle, charging plates and deflecting plates may be fixed in place or travel from side-to-side across the substrate. Also within the scope of the invention is to provide an array of overlapping, fixed nozzles across the width of the substrate to be printed. Various combinations of solution of dyes and printing heads may be employed. In one embodiment of the invention, four arrays of printing heads containing cyan, yellow, magenta and black dye solutions are provided.

The invention may be further understood by reference to the following claims.

We claim:

1. An apparatus for printing on a substrate, comprising:

(a) a nozzle capable of emitting a stream of individual droplets of liquid toward the substrate;

(b) a droplet charging section capable of providing an electrical charge to the droplets;

(c) a pair of electrically conductive deflecting plates for creating an electrical field capable of deflecting the droplets to a desired location of the substrate, wherein each of the plates has an interior side facing the path of the stream of individual droplets of liquid, and wherein an outer layer of the interior side of at least one of the deflecting plates is a dielectric.

2. The apparatus of claim 1, wherein the dielectric outer layer is selected from the group consisting of dielectric coatings and metal oxides grown on the surface of the deflecting plate.

3. The apparatus of claim 1, wherein the interior sides of both deflecting plates have a dielectric outer layer.

4. The apparatus of claim 1, wherein the dielectric outer layer is a polymer.

5. The apparatus of claim 4, wherein the dielectric polymer is selected from the group consisting of poly(p-xylylene) polymers, silicone polymers, polyurethanes, epoxy polymers, polyolefins, and polyacrylates.

6. The apparatus of claim 1, wherein the dielectric outer layer is selected from the group consisting of poly(p-xylylene), poly(3-chloro-p-xylylene) and poly(3,6-dichloro-p-xylylene).

7. The apparatus of claim 6, wherein the dielectric outer layer is applied by vapor deposition.

8. The apparatus of claim 1, wherein the dielectric outer layer has a dielectric strength of greater than 500 V/mil.

9. The apparatus of claim 1, wherein the dielectric outer layer has a thickness of 100 nm to 0.1 mm.

10. The apparatus of claim 1, further comprising a hydrophobic film overlaying the dielectric outer layer, wherein the contact angle between water and the hydrophobic film is 85° or greater.

11. The apparatus of claim 1, further comprising a hydrophobic film overlaying the dielectric outer layer, wherein the hydrophobic film is selected from the group consisting of functionalized and unfunctionalized polyolefins, polytetrafluoroethylenes, glass, quartz, epoxies, polyacrylates, and polyurethanes.

12. The apparatus of claim 1, further comprising a hydrophobic film overlaying the dielectric outer layer, wherein the hydrophobic film comprises fluoroalkyl acrylate copolymer and fumed silica.

13. The apparatus of claim 12, wherein the hydrophobic film further comprises a crosslinkable polymer and a crosslinking agent.

14. The apparatus of claim 1, wherein the dielectric outer layer is selected from the group consisting of oxides of Al, Ti, Ta, Nb, Zr, Hf, W, Si and perovskites.

15. The apparatus of claim 14, wherein the deflecting plates are aluminum and the dielectric outer layer is $Al_2O_3$ formed by etching the deflecting plate and growing the $Al_2O_3$ on the etched surface.

16. The apparatus of claim 14, further comprising a hydrophobic film overlaying the dielectric outer layer, wherein the contact angle between water and the hydrophobic film is 85° or greater.

17. The apparatus of claim 1, wherein the dielectric outer layer is hydrophobic with a contact angle between water and the dielectric layer of 85° or greater.

18. The apparatus of claim 1, wherein the liquid is aqueous and comprises a colorant selected from the group consisting of acid dyes, disperse dyes and reactive dyes.

19. A method of printing on a substrate, comprising the steps of:

(a) emitting a stream of individual droplets of liquid toward the substrate with a nozzle;

(b) providing an electrical charge to the droplets;

(c) deflecting the droplets to a desired location of the substrate, using a pair of electrically conductive deflecting plates capable of creating an electrical field, wherein each of the plates has an interior side facing the path of the stream of individual droplets of liquid, and wherein an outer layer of the interior side of at least one of the deflecting plates is a dielectric.

20. The method of claim 19, wherein the interior sides of both deflecting plates have a dielectric outer layer.

21. The method of claim 20, wherein the dielectric outer layer is selected from the group consisting of dielectric polymer coatings and metal oxides.

22. The method of claim 21, further comprising a hydrophobic film overlaying the dielectric outer layer, wherein the contact angle between water and the hydrophobic film is 85° or greater.

* * * * *